United States Patent [19]

Hepworth

[11] Patent Number: 4,922,886

[45] Date of Patent: May 8, 1990

[54] TILE PARTING DEVICE

[75] Inventor: Paul S. Hepworth, Surrey, England

[73] Assignee: Plas Plugs Limited, Burton on Trent, England

[21] Appl. No.: 152,044

[22] Filed: Feb. 4, 1988

[51] Int. Cl.[5] ..... B28D 1/32

[52] U.S. Cl. ..... 125/23.01; 125/23.02; 225/96.5

[58] Field of Search ..... 225/96.5, 93; 125/23 T, 125/23 C, 23 R

[56] References Cited

U.S. PATENT DOCUMENTS

| | | | |
|---|---|---|---|
| 1,995,741 | 3/1935 | Granite | 125/23 T |
| 2,513,876 | 7/1950 | Judd, Jr. | 225/96.5 |
| 4,026,262 | 5/1977 | Yasuga | 225/96.5 X |
| 4,378,782 | 4/1983 | Richard et al. | 225/96.5 X |
| 4,693,232 | 9/1987 | Yasuga | 225/96.5 X |
| 4,770,156 | 9/1988 | Boada Sucarrats | 225/96.5 X |

FOREIGN PATENT DOCUMENTS

| | | | |
|---|---|---|---|
| 2814835 | 10/1979 | Fed. Rep. of Germany | 125/23 T |
| 742809 | 1/1956 | United Kingdom | 225/93 |

*Primary Examiner*—Douglas D. Watts
*Assistant Examiner*—Rinaldi Rada
*Attorney, Agent, or Firm*—Spensley, Horn, Jubas & Lubitz

[57] ABSTRACT

A tile 14 to be parted along a pre scored parting line is grasped between a pair of elements 36 which contact one surface of the tile on either side of the line, and a further element 30 which contacts the opposite surface of the tile on the line itself. Downward pressure on a handle member 26 then causes a jaw member 28 on which the element 30 is mounted to pivot about a fixed axis 18 to apply a parting pressure to the tile. In order to adjust the starting position of the element 30 to suit different thicknesses of tile, the member 28 is carried on a cam member 20 so that it can be rotated about a second axis which is eccentrically disposed relative to the axis 18.

17 Claims, 3 Drawing Sheets

TILE PARTING DEVICE

The invention relates to a device for parting a member, such as a tile parting device. The device is suitable for use with many types of tile, particularly but not exclusively with so-called quarry tiles.

It is an object of the invention to provide a device capable of parting tiles or other members which has the facility to cope with a range of thicknesses.

The invention provides a tile parting device comprising a main body portion including two surfaces arranged side by side and spaced apart by a channel said surfaces being arranged in use to contact a tile to be parted so that one surface contacts an obverse face of said tile adjacent to and to one side of the desired parting line and the other surface contacts said obverse face adjacent to and to the second side of said line, said surface comprising a first, fixed, jaw means, and a second, movable, jaw means comprising a pivotable member having a tile-contacting member adapted in use to provide at least a point contact with a reverse face of a tile along the desired parting line, wherein there is provided a handle device the operation of which causes said movable jaw to pivot about a first pivot line fixed with respect to said body member, means being provided to adjust the starting position of said movable jaw means in a closing movement, said means comprising a cam member including a part cylindrical surface described about a second pivot line, wherein adjustment of said starting position is achieved by a controlled rotary movement of the member about said second pivot line, said cam member having said first pivot line passing therethrough and eccentric with respect to said part-cylindrical surface.

Advantageously said cam member has a substantially D-shaped cross-section and end portions are received in D-apertures in an extension means fixedly secured to or integral with said handle so as to cause rotation about said first pivot line when the handle is operated, an intermediate portion of said cam member being rotatably received in a circular aperture of said pivotable jaw member which member is adjustably rotatable about said second pivot line with respect to the cam member.

Conveniently, the main body portion is mounted in a frame for sliding movement with respect thereto along rails. Thus tile scoring means may be provided upon the handle extension means to mark a score line upon the obverse face of the tile as the body portion is caused to slide along the rails.

In the example of the invention to be described below the frame may be provided with a base plate on which are displayed measuring graduations for accurate positioning of the parting line. The graduations may be associated with an abutment upon the base plate against which the tile may be placed for marking of the score line.

There will now be described a tile parting device in accordance with the invention. It will be understood that the description, which is to be read with reference to the drawings, is given by way of example only and not by way of limitation.

Figure 1:
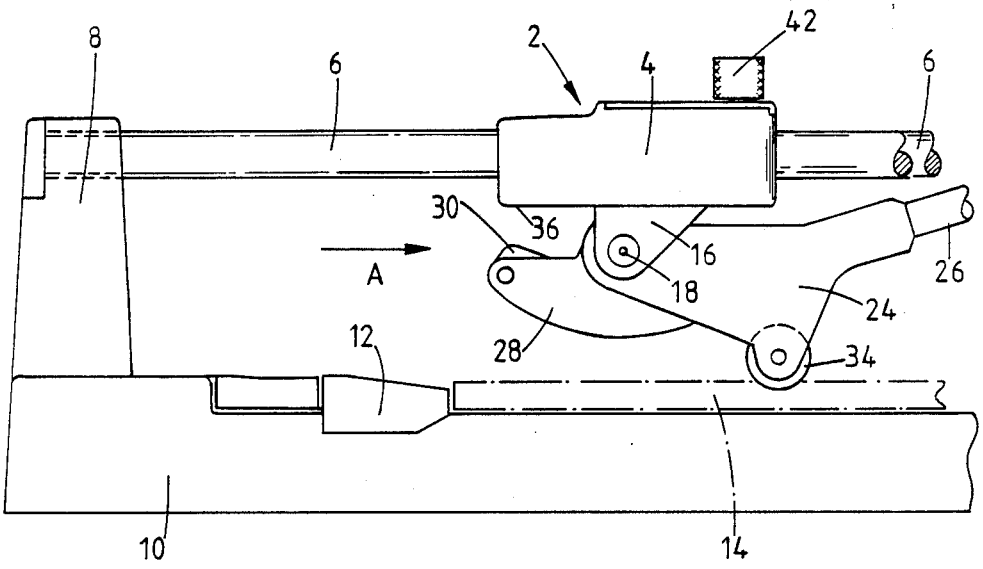
FIG. 1 is a side view of the device and one end of a frame mounting the device.

The tile parting device indicated at 2 comprises a main body portion 4 mounted for sliding movement along two rails 6 of a frame 8. The frame includes a base plate 10 having measuring graduations (not shown) marked upon an abutment member 12 against which a tile (shown at 14 in chain-dot lines) may be positioned.

Figure 3:
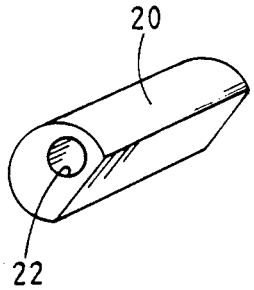
FIG. 3 is a perspective view of a cam member.
Figure 4:
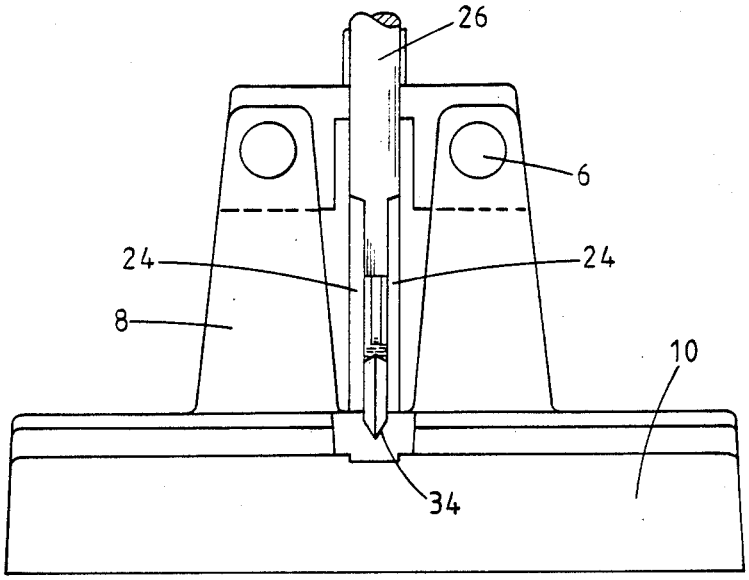
FIG. 4 is an end view of the device seen from the opposite end of the frame.

Depending from the body portion 4 are a pair of brackets 16 each having an aperture through which pass a pivot pin 18. The pin 18 bridges the brackets and supports therebetween a cam member 20 (FIG. 3) whose external cross-section is defined in part by an arc centred on the centre line of the cam member. The pin 18 passes through a bore 22 in the cam member 20 which is eccentric with respect to the centre line of the latter.

Mounted for pivotal movement about said in 18 is an extension portion 24 of an operating handle 26. The portion 24 comprises two congruent plate-like members within which are received a pivotable jaw member 28 upon one arm of which is provided a tile contacting element 30. The member 28 has a circular aperture 32 (FIG. 5) through which passes the cam member 20. The cam member 20 traverses the bracket plate 24 through closely fitting D-shaped apertures thus preventing any relative rotating movement therebetween. The bracket plates 24 also carry a tile-scoring wheel 34, operable by sliding the body portion 4 along the rails 6 by means of the handle 26.

Provided on the underside of the body member 4 are two spaced apart elements 36 adapted to contact the obverse face of a tile 14 upon which a score line has been made as described briefly above. These elements constitute fixed jaw means whilst a movable jaw is constituted by the element 30 on the pivotable member 28 which contacts the reverse of the tile.

The tile parting operation will be described later in the specification with reference to FIGS. 6 to 8, but, briefly, involves the movement of the element 30 upwardly, towards the elements 36. However, it is desirable for there to be a controlled degree of force exerted upon the tile and this may well be difficult to achieve consistently irrespective of the thickness of the tile. It is therefore advisable to achieve a pre-determined degree of movement but clearly this movement will have a different starting point according to the thickness of the tile.

Figure 5:
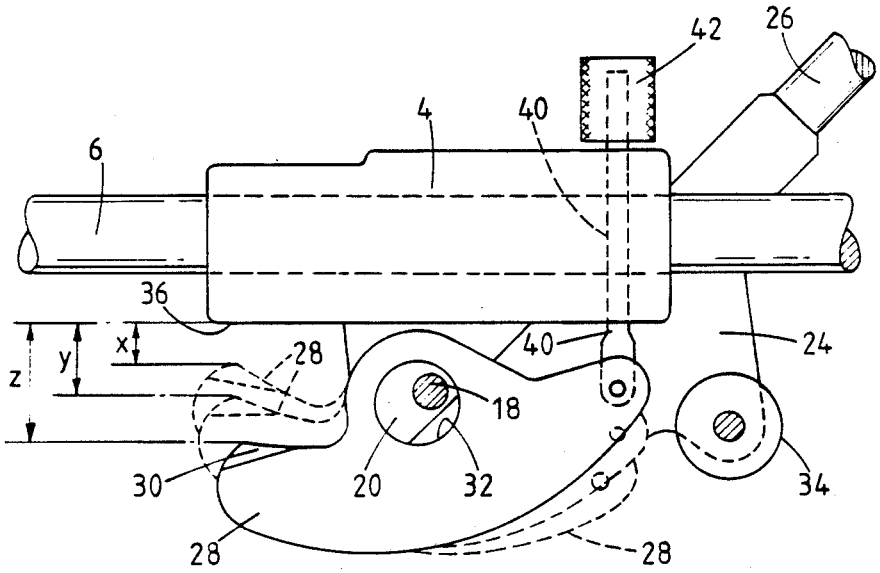
FIG. 5 is a side view of the device to an enlarged scale.

Referring to FIG. 5, the starting position of a comparatively thin tile of a thickness x will be higher than tiles of a thickness y or z and therefore the starting position of the tile parting movment (when the jaws 36 and 30 are merely in initial contact with the tile) must be adjusted.

Pivotally secured on the member 28 is a threaded tie rod 40 which passes through an oversize aperture in the body member 4 into an internally threaded adjustment knob 42. The extent to which the rod is received within the knob 42 determines the rotary angle of the member 28 about the circumference of the cam member 20. It should be noted that the cam member is captive in the bracket plates 24, one of which is broken away in FIG. 5 for the sake of clarity. Thus the member 28 will rotate about the centre line of the member 20 to take up the appropriate position according to tile thickness x, y or z in this example.

Figure 6:
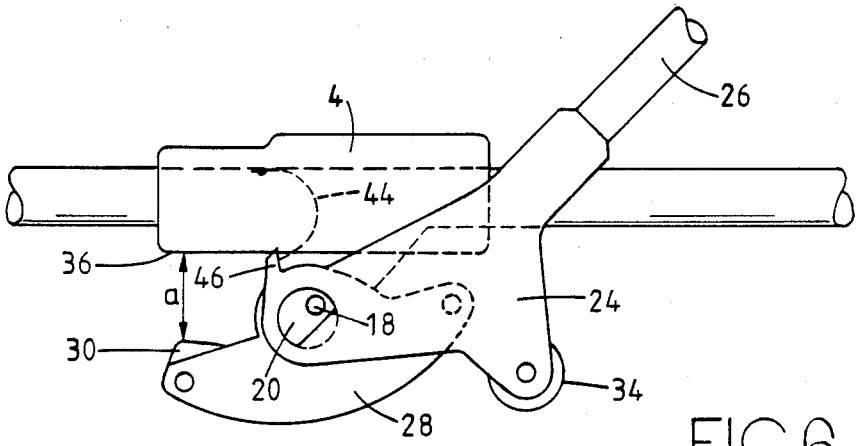
FIGS. 6 to 8 illustrate stages in the tile parting operation of the device.
Figure 7:
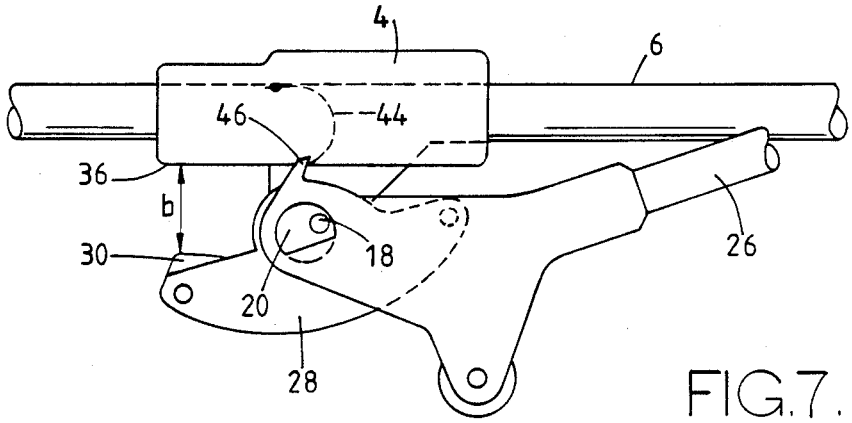
Figure 8:
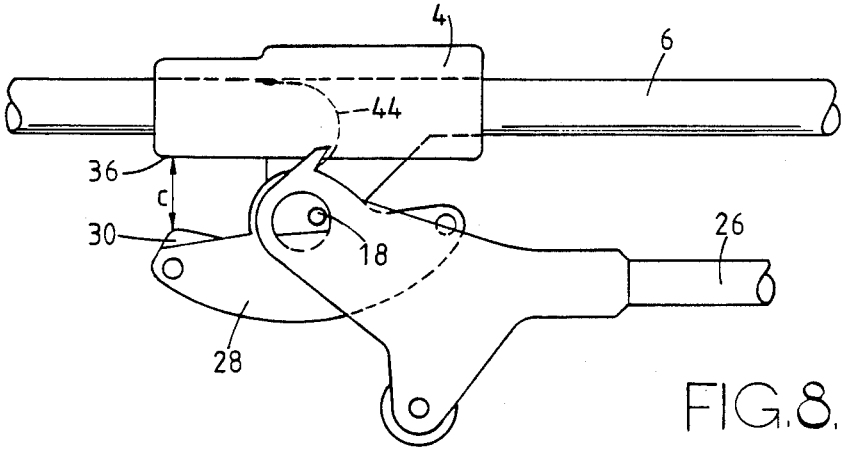

Thus, irrespective of the tile thickness, the effective tile parting movement is arranged to be through a predetermined distance, being the difference between a and c in FIGS. 6 to 8. These Figures illustrate the operation of the tile parting stage after the jaw member 28 has been moved about the true centre line of cam member 20 to cause the tile contacting element 30 (the jaw tip) to contact a tile having a thickness of a, on its reverse side whilst the obverse is in light contact with the elements 36.

Figure 2:
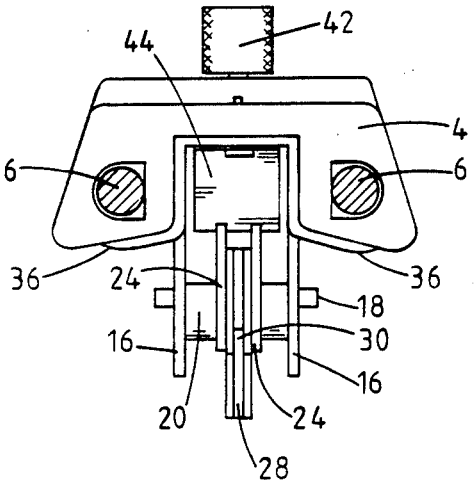
FIG. 2 is a view in the direction of arrow A of FIG. 1.

Movement of the handle 26 downwardly causes the plates 24, the cam member 20 and the member 28 to pivot about pivot line 18. It will be observed that the handle 26 is biased into its upper position (FIG. 6) by means of curved steel spring 44 (see also FIG. 2) the lower end of which is engaged by a projection 46 on each of the plates 24.

As the handle is lowered, the distance a of FIG. 6 is reduced to distance b of FIG. 7. The tile may be expected to part as the handle continues down to the lowest position shown (FIG. 8) at which the distance between the jaws has its smallest value c.

Thus, once the tile thickness has been accommodated in the jaws the operation of the handle may be carried out with no further precautions to ensure a clear parting line, since the large downward movement can only be translated into a limited jaw movement.

After use, the handle returns to the position shown in FIG. 6 under the influence of the spring 44.

Various modifications may be made within the scope of the invention.

I claim:

1. A device for parting a member along an intended parting line, comprising:

a main body portion, a pair of first contact elements provided on the main body portion, the first contact elements being spaced apart laterally of the intended parting line, a jaw member including a second contact element and having a circular aperture therein, means for mounting the jaw member on the main body portion for movement about a first axis to move the second contact element toward and away from the first contact elements, the first axis bing fixed relative to the main body portion, a handle device communicating with the main body portion and operative to cause the second contact element to move about the first axis, the handle device including a manually graspable handle member, means for mounting the second contact element on the main body portion for independent movement about a second axis, the second axis being spaced from and parallel to the first axis, and adjustment means for performing adjusting movement of the second contact element angularly about the second axis, whereby a starting position of the second contact element can be varied, the adjustment means including a cam member having an external surface, at least part of the external surface being defined in cross-section by an arc centered on the second axis, the cam member being rotatably received within the circular aperture in the jaw member and being fixed relative to the handle.

2. The device according to claim 1, wherein the first axis passes through the cam member.

3. The device according to claim 1, wherein the cam member has an external cross-section which is substantially D-shaped, the handle member has aperture means therein which is also substantially D-shaped, and the cam member is located in the aperture means.

4. The device according to claim 1, wherein the handle member includes a pair of laterally spaced extension portions which are spanned by the cam member, and the jaw member is located between the extension portions.

5. The device according to claim 1, wherein the adjustment means includes a knob rotatably mounted on the main body portion and a threaded element connecting the knob to the second contact element, the knob being rotatable to cause adjusting movement of the second contact element about the second axis.

6. The device according to claim 1, further comprising biassing means for biassing the second contact element towards the starting position.

7. The device according to claim 6, wherein the biassing means acts upon the manually graspable handle member of the handle device.

8. The device according to claim 1, further comprising a frame, means for mounting the main body portion on the frame for sliding movement along the frame, and scoring means carried by the main body portion for movement relative to the frame, whereby a score line can be marked on the member to be parted.

9. The device according to claim 8, wherein the scoring means is mounted on the manually graspable handle member of the handle device.

10. A device for parting a member along an intended parting line, comprising:

a main body portion, a pair of first contact elements provided on the main body portion, the first contact elements being spaced apart laterally of the intended parting line, a second contact element, means for mounting the second contact element on the main body portion for movement about a first axis toward and away from the first contact elements, the first axis being fixed relative to the main body portion, a handle member communicating with the main body portion and operative to cause the second contact element to move about the first axis, means for mounting the second contact element on the main body portion for independent movement about a second axis, the second axis being spaced from and parallel to the first axis, and adjustment means for performing adjusting movement of the second contact element angularly about the second axis, whereby a starting position of the second contact element can be continuously varied.

11. The device according to claim 10, wherein the adjustment means includes a cam member having an external surface, at least part of the external surface being defined in cross-section by an arc centered on the second axis.

12. The device according to claim 11, wherein the first axis passes through the cam member.

13. The device according to claim 10, wherein the adjustment means includes a knob rotatably mounted on the main body portion and a threaded element connecting the knob to the second contact element, the knob being rotatable to cause adjusting movement of the second contact element about the second axis.

14. The device according to claim 10, further comprising biassing means for biassing the second contact element towards the starting position.

15. The device according to claim 14, wherein the handle device includes a manually graspable handle member and wherein the biassing means acts upon the manually graspable handle member of the handle device.

16. The device according to claim 10, further comprising a frame, means for mounting the main body portion on the frame for sliding movement along the frame, and scoring means carried by the main body portion for movement relative to the frame, whereby a score line can be marked on the member to be parted.

17. The device according to claim 16, wherein the handle device includes a manually graspable handle member and wherein the scoring means is mounted on the manually graspable handle member of the handle device.

* * * * *

UNITED STATES PATENT AND TRADEMARK OFFICE

CERTIFICATE OF CORRECTION

PATENT NO. : 4,922,886

DATED : May 8, 1990

INVENTOR(S) : Paul S. Hepworth

It is certified that error appears in the above-identified patent and that said Letters Patent is hereby corrected as shown below:

On the title page, please insert --[30] Foreign Application Priority Data Feb. 4, 1987 [UK] United Kingdom.....8702491--

Signed and Sealed this

Twenty-fifth Day of June, 1991

*Attest:*

*Attesting Officer*

HARRY F. MANBECK, JR.

*Commissioner of Patents and Trademarks*